US005695184A

United States Patent [19]

Miller et al.

[11] Patent Number: 5,695,184

[45] Date of Patent: Dec. 9, 1997

[54] DOCUMENT PRODUCTION MACHINE HAVING A HIGH CAPACITY, HIGH RELIABILITY CASSETTE TRAY SHEET FEEDING ASSEMBLY

[75] Inventors: Gregory P. Miller, Rochester; Carl W. Holland, Webster, both of N.Y.

[73] Assignee: Xerox Corporation, Stamford, Conn.

[21] Appl. No.: 673,594

[22] Filed: Jul. 1, 1996

[51] Int. Cl.[6] ..... B65H 3/52

[52] U.S. Cl. ..... 271/121; 271/170

[58] Field of Search ..... 271/117, 121, 271/162, 164, 170, 10.11

[56] References Cited

U.S. PATENT DOCUMENTS

| | | | |
|---|---|---|---|
| Re. 25,825 | 7/1965 | Springer | 271/170 |
| 3,306,491 | 2/1967 | Eisner et al. | 271/117 X |
| 3,408,064 | 10/1968 | Johnson et al. | 271/61 |
| 3,588,106 | 6/1971 | Csaba | 271/117 X |
| 3,599,972 | 8/1971 | Miciukiewicz | 271/39 |
| 4,358,102 | 11/1982 | Hoshizaki et al. | 271/164 |
| 4,591,141 | 5/1986 | Wentzel et al. | 271/127 |
| 4,734,738 | 3/1988 | Yamanaka et al. | 271/121 X |

FOREIGN PATENT DOCUMENTS 47146600 9/1974 Japan .

*Primary Examiner*—David H. Bollinger
*Attorney, Agent, or Firm*—Tallam I. Nguti

[57] ABSTRACT

A high capacity, high reliability cassette tray sheet feeding assembly for supporting a high capacity stack of sheets, and for feeding such sheets with a high degree of reliability, one at a time, in a sheet using machine. The high capacity, high reliability cassette tray sheet feeding assembly includes a cassette frame for removing and reinstalling into a sheet supply station of the sheet using machine. The cassette frame has a front end over which sheets are fed into the machine, and a forward feed corner snubber that is mounted to one corner of the front end of the cassette frame for preventing the feeding of multiple sheets at a time. The cassette frame includes a fixed position stationary base plate within the cassette frame for supporting a high capacity stack of sheets having a topmost sheet. The high capacity, high reliability cassette tray sheet feeding assembly further includes a variable position sheet receiving path, and a pivotable feed wheel assembly for reliably feeding topmost sheets seriatim from the fixed position stationary base plate into the variable position sheet path. The pivotable feed wheel assembly has a first position for a full stack of sheets, and a second position for an empty base plate. Importantly, the pivotable feed wheel assembly has a constant sheet feeding angle, and a constant sheet feeding normal force, for enabling continuous high reliability feeding of sheets from the first through to the second position thereof.

12 Claims, 7 Drawing Sheets

DOCUMENT PRODUCTION MACHINE HAVING A HIGH CAPACITY, HIGH RELIABILITY CASSETTE TRAY SHEET FEEDING ASSEMBLY

BACKGROUND OF THE INVENTION

This invention relates to document production or reproduction machines in general, and particularly to such a machine having a high capacity, high reliability cassette tray sheet feeding assembly for holding a high capacity stack of sheets, and for feeding such sheets with a high degree of reliability within the machine.

Document productions machines include all types of printers, as well as electrostatographic process reproduction machines. Generally, the process of electrostatographic reproduction machines includes uniformly charging an image frame of a moving photoconductive member, or photoreceptor, to a substantially uniform potential, and imagewise discharging it or imagewise exposing it to light reflected from an original image being reproduced. The result is an electrostatically formed latent image on the image frame of the photoconductive member. For multiple original images, several such frames are similarly imaged. The latent image so formed on each frame is developed by bringing a charged developer material into contact therewith. Two-component and single-component developer materials are commonly used. A typical two-component developer material comprises magnetic carrier particles, also known as "carrier beads," having fusable charged toner particles adhering triboelectrically thereto. A single component developer material typically comprises charged toner particles only.

In either case, the fusable charged toner particles when brought into contact with each latent image, are attracted to such image, thus forming a toner image on the photoconductive member. The toner image is subsequently transferred at a transfer station to an image receiver or copy sheet. The copy sheet is then passed through a fuser apparatus where the toner image is heated and permanently fixed to the copy sheet, thus forming a hard copy of the original image. The copy sheets typically am held and positioned (for feeding to the transfer station) in a motorized elevator sheet supply assembly within the machine, or in a non-motorized portable or removable spring and pivot cassette tray assembly cooperating with a fixed position feed wheel assembly.

Conventional non-motorized spring loaded and pivoting type cassette trays or tray assemblies of the sort are well known. Typically, forward feed corner snubber type cassette tray cooperating with a fixed position feed wheel assembly can effectively hold and reliably feed only up to a maximum of 250 sheets per full tray in image reproduction machines. The following patents disclose examples of such cassette trays.

U.S. Pat. No. 4,591,141 entitled "First Point Sheet Feeder", discloses a sheet feeder that is pivotably mounted so that the paper supply is maintained in contact with a fixed position feed roller. The sheet feeder's pivot point is selected to provide constant feed pressure to the paper supply regardless of the size of the remaining paper supply.

U.S. Pat. No. 4,358,102 entitled "Copy Paper Feeding Cassette" discloses a cassette that has a cutout or gate centrally defined in each wall of the cassette. The cassette also has a reinforcing plate pivotally mounted at a forward portion of each side wall. Upon mounting in a machine, the reinforcing plates bridge the cutouts or gate and cooperate with machine members to prevent skewed feeding of a topmost sheet.

U.S. Pat. No. 3,599,972 entitled "Paper Tray for Photocopy Machine" discloses a floating feed tray including a pair of feed rollers positioned above the forward end of the tray and mounted on a fixed axis. The rearward end of the tray is biased downwardly to pivot the tray about a pivot point so as to raise the forward end to bring the topmost sheet into feeding engagement with the feed rollers.

JP 47-146600 (Canon KK) Sep. 9, 1974, Utility Model discloses a paper feeding cassette including a sheet separating pivot or snubber that shifts from the paper feeding positions when sheets are being loaded.

U.S. Pat. No. 3,408,064 entitled "Auxiliary Paper Tray for Copying Machine" discloses a paper tray that has lateral and end guides or walls that are fixedly attached to the bottom plate of the tray to accommodate a stack of sheets.

As illustrated in FIGS. 1 and 2 of the drawings, such non-motorized, removable conventional cassette tray assemblies, for example, those that have forward feed corner snubbers cooperating with a fixed position feed roller, are very sensitive to a stack-height dependent sheet feeding angle. The sheet feeding angle being defined by the top of a stack of sheets relative to a horizontal plane through the corner snubber. They are also very sensitive to variations in a normal force acting through the sheet feeding nip. Variations in the sheet feeding angle also detrimentally affects the length FL1, FL2 or amount of each sheet fed per feed stroke or feed cycle of the feed wheelsat full and at near empty states of the cassette tray.

Referring still to FIGS. 1 and 2, a conventional cassette tray assembly 200 is illustrated in the full position (FIG. 1) and in the near empty position (FIG. 2). The conventional cassette tray assembly 200 has a single piece base plate 202 that is mounted pivotably to a cassette frame 74. The base plate 202 is supported by a compression spring 226 towards its front end, below a fixed position rotatable feed wheel or roller 33. As shown, the topmost sheet in the stack has a plane 212 when the springs 226 are compressed by the feed wheel 33 during a feeding stroke. The compressed spring pushes up on the pivotably movable base plate, applying an upward net normal force P1 at the sheet feeding nip when the base plate has a full stack of sheets thereon. The net force P1 is the difference between the maximum force of the spring 226 and the weight of the stack of sheets on the base plate 202. Accordingly, when the base plate is near empty with almost no weight of a stack of sheets acting down on the spring, a greater net normal force P2 will act and push upwardly on the sheet feeding nip. This variation in the normal force contributes to unreliability of a conventional cassette tray assembly in sheet feeding.

Additionally as shown, the sheet feeding angle F1° measured as the angle between the top of a stack of sheets and a horizontal plane through the corner snubber is approximately 2° when the cassette tray is full. Full conventional cassette trays (FIG. 1) with a small sheet feeding angle F1° of about 2° therefore work more reliably and effectively than partially full or near-empty ones (FIG. 2) where a larger sheet feeding angle F2° undesirably has increased substantially by more than 9° to approximately 11.3°. Such variability in both the sheet feeding angle, and the normal force at the sheet feeding nip are significant factors that undesirably limit sheet holding capacity, and sheet feeding reliability in conventional, non-motorized snubber type cassette trays.

There has therefore been a need for a relatively low cost, and highly reliable snubber type cassette tray assembly that can hold and position as well as reliably feed from stacks of sheets greater than the ordinarily limited 250 sheet maximum.

SUMMARY OF THE INVENTION

In accordance with the present invention, there is provided a high capacity, high reliability cassette tray sheet feeding assembly for supporting a high capacity stack of sheets, and for feeding such sheets with a high degree of reliability, one at a time, in a sheet using machine. The high capacity, high reliability cassette tray sheet feeding assembly includes a cassette frame for removing and reinstalling into a sheet supply station of the sheet using machine. The cassette frame has a font end over which sheets are fed into the machine, and a forward feed corner snubber that is mounted to one corner of the front end of the cassette frame for preventing the feeding of multiple sheets at a time. The cassette frame includes a fixed position stationary base plate within the cassette frame for supporting a high capacity stack of sheets having a topmost sheet. The high capacity, high reliability cassette tray sheet feeding assembly further includes a variable position sheet receiving path, and a pivotable feed wheel assembly for reliably feeding topmost sheets seriatim from the fixed position stationary base plate into the variable position sheet path. The pivotable feed wheel assembly has a first position for a full stack of sheets, and a second position for an empty base plate. Importantly, the pivotable feed wheel assembly has a constant sheet feeding angle, and a constant sheet feeding normal force, for enabling continuous high reliability feeding of sheets from the first through to the second position thereof.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternative, modifications, and equivalents as may be included within the spirit and scope of the invention as defined by the appended claims.

Figure 8:
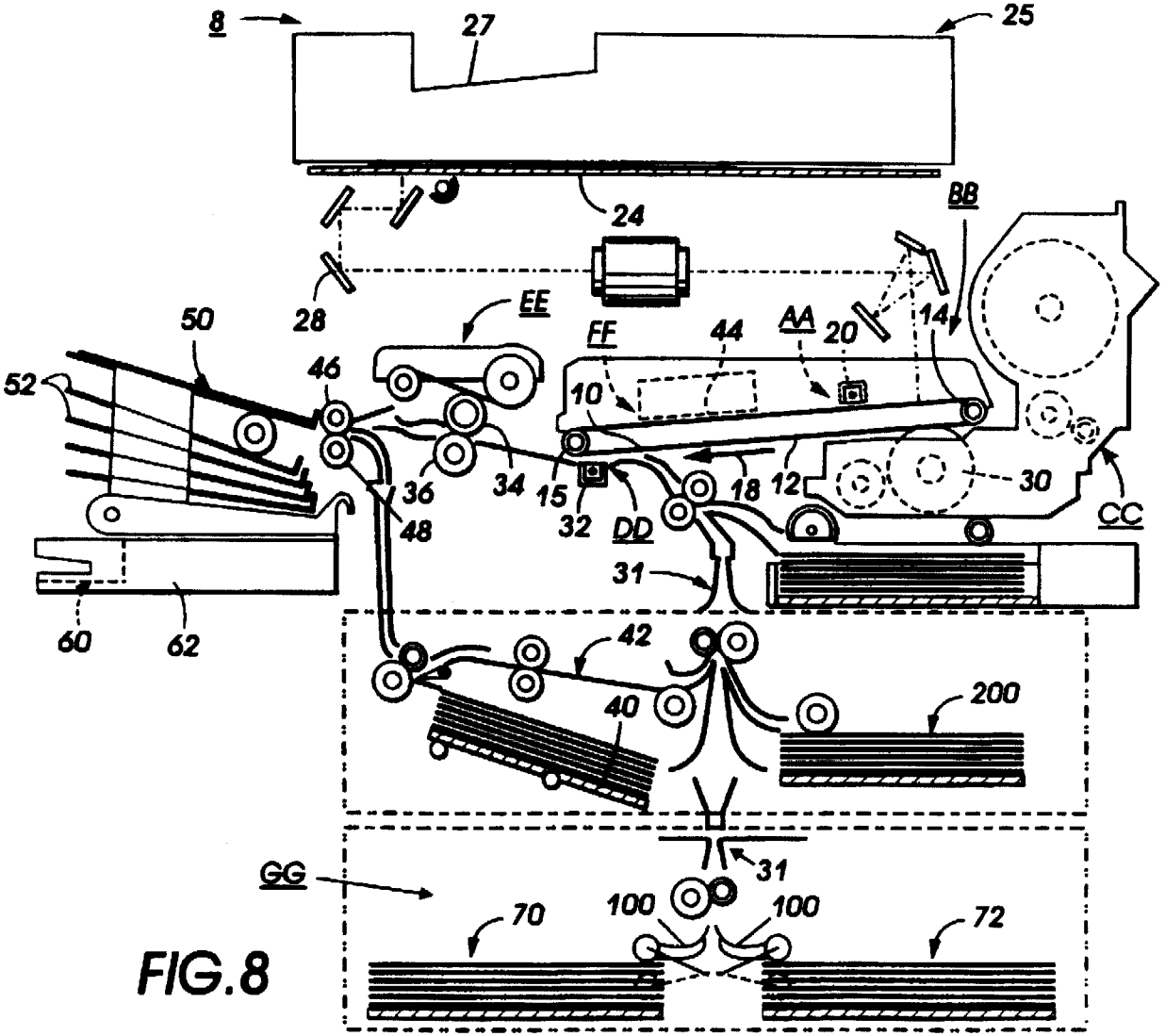
FIG. 8 is a vertical schematic of an exemplary electrostatographic reproduction machine including the high capacity, high reliability cassette tray sheet feeding assembly in accordance with the present invention.

Referring first to FIG. 8, a document production machine in the form for example of an exemplary electrostatographic reproduction machine 8 according to the present invention is illustrated. As shown, the machine 8 has conventional imaging processing stations associated therewith, including a charging station AA, an imaging/exposing station BB, a development station CC, a transfer station DD, a fusing station EE, and a cleaning station FF. Importantly, the machine 8 includes a sheet supply station shown generally as GG, that includes the non-motorized high capacity high reliability cassette tray sheet feeding assembly of the present invention (to be described in detail below). The sheet supply station GG advantageously may also include a conventional snubber type cassette tray assembly shown as 200.

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed from a sheet cassette tray, for example, from the high capacity, high reliabilty cassette tray sheet feeding assembly 70, 72 of the present invention (to be described in detail below). As shown, the sheets so fed are taken away by a copy sheet handling system 31 for transport to the transfer station DD.

At the transfer station DD, a corona generating device 32 is provided for charging the copy sheet so as to attract the charged toner image from the photoconductive belt 10 to the copy sheet. The copy sheet with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet then, as is well known, may be selectively transported to the finishing area, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to finishing area input rolls 46 and 48. From the input rolls 46, 48, the copy sheets are fed, for example, individually to an output tray (not shown) or to a bin sorter apparatus 50 where the sheets can be arranged in a collated unstapled set within the tray or within each bin 52 of the bin sorter apparatus. The bin sorter apparatus 50 can comprises any number of bins 52. A machine user making such set of copy sheets on the reproduction machine 8 can thus manually remove each such set at a time, and insert a corner or edge of the set into a convenience stapler assembly 60 that is built into a portion 62 of the frame of the machine 8.

Referring now to FIGS. 3 to 7, the high capacity, high reliability cassette tray sheet feeding assembly 70, 72 of the present invention is illustrated in detail. Cassette tray sheet feeding assemblies 70 and 72 are generally and conceptually identical in design and operation except that the assembly 70 is adapted to feed sheets short edge first, and the assembly 72 is adapted to feed sheets long edge first. Therefore, a detail description of the concepts of 70 will suffice 72.

Figure 1:
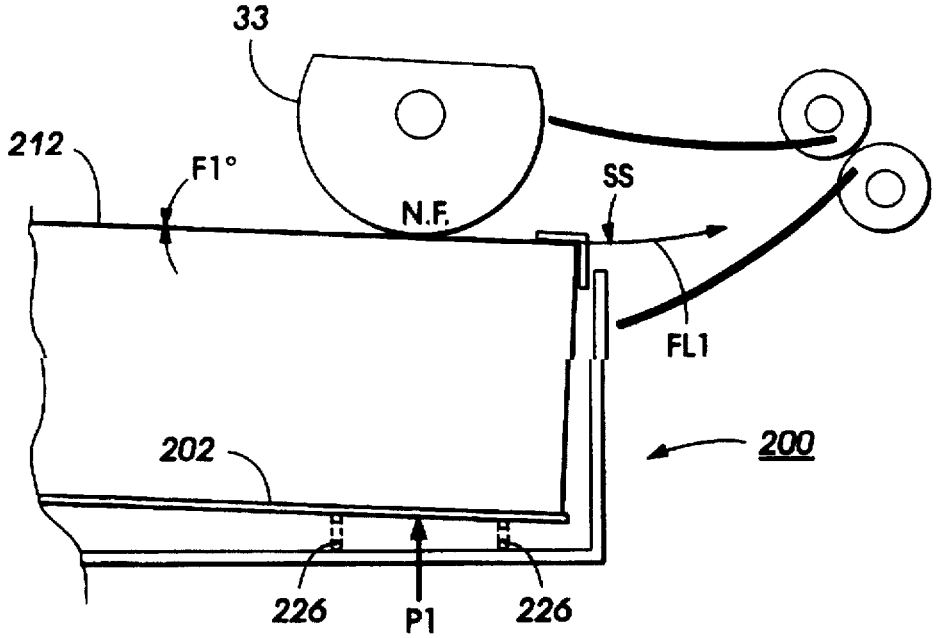
FIG. 1 PRIOR ART
FIGS. 1 and 2 are schematics of conventional (fixed position feed wheels and pivoting base plate) type cassette trays showing variable sheet feeding angles and variable sheet feeding normal forces at the full and near empty states, respectively.
Figure 2:
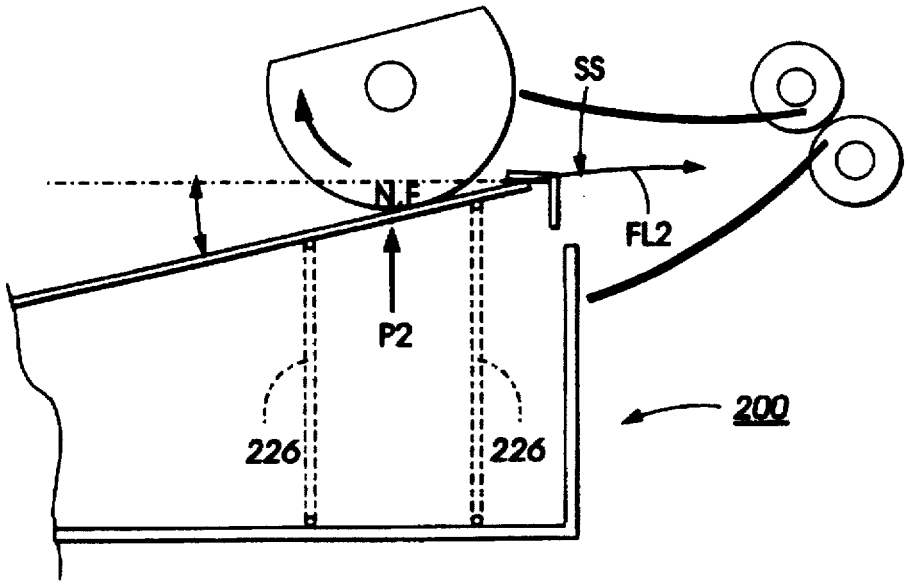
FIG. 2 PRIOR ART
Figure 3:
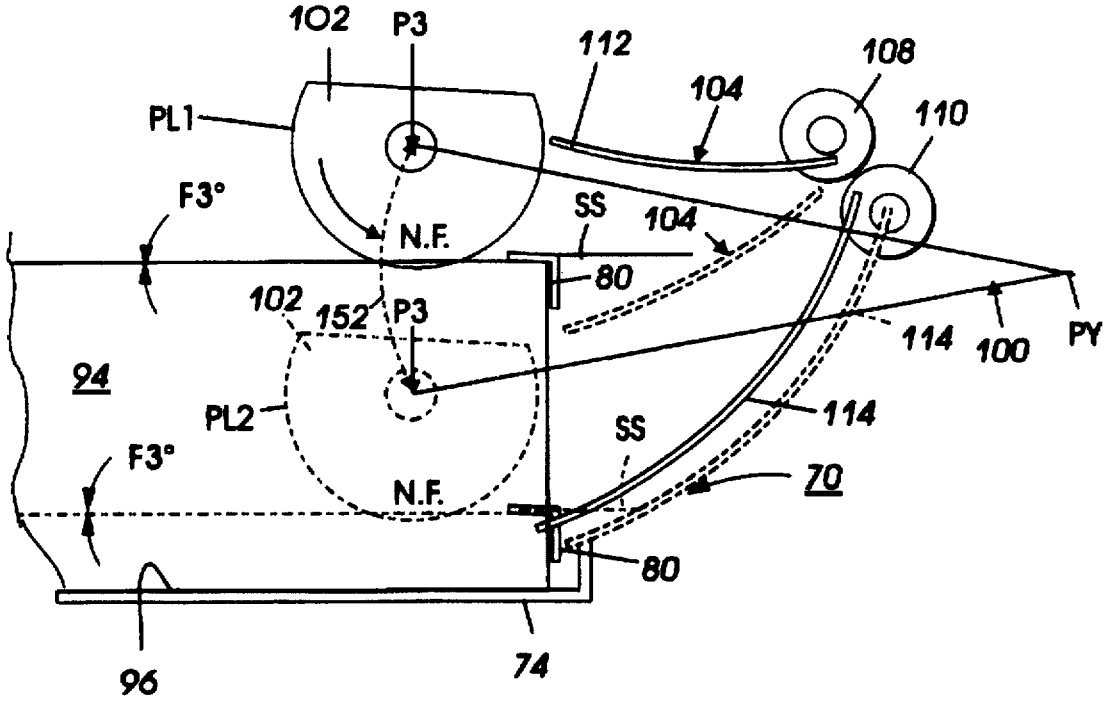
FIG. 3 is schematic illustration of the high capacity, high reliability cassette tray sheet feeding assembly of the present invention showing a constant sheet feeding angle and a constant normal force at the sheet feeding nip, both at the full and at the empty states of the cassette tray.
Figure 4:
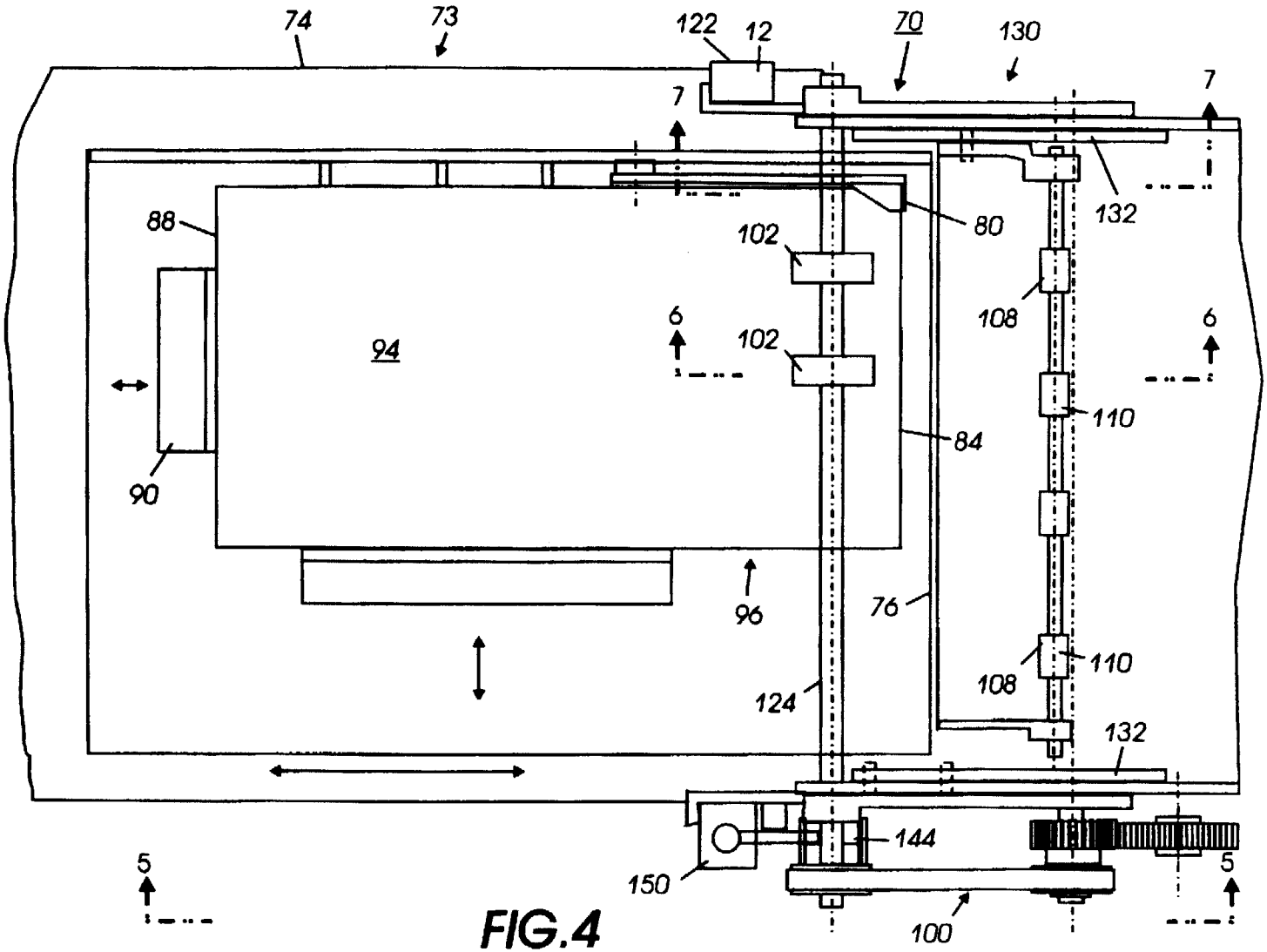
FIG. 4 is a schematic plan view of the high capacity, high reliability cassette tray sheet feeding assembly of the present invention.

As shown in FIGS. 3 an. 4, the cassette tray sheet feeding assembly 70 of the present invention includes a cassette 73 having a frame 74 that can be removed and reinstalled into the sheet supply station GG of the machine 8. The cassette frame 74, as is well known, can be a portable frame member that contains a single cassette tray and that can be completely removed from the sheet supply station, placed on a platform to be reloaded with sheets, and then reinstalled into the supply station. Alternatively, as illustrated (FIG. 8) the cassette frame 74 can be part of a multiple tray drawer frame usually holding more than one non-motorized, removable cassette tray. The drawer frame is retractable from the sheet supply station for sheet reloading, and is reinstallable into a sheet feeding position within the sheet supply station of the machine.

The cassette frame 74 in either case has a front, or feeding end 76 (for short edge fed sheets) over which sheets are fed, one at a time, to the sheet handling apparatus 31, and then to the image transfer station DD of the machine 8. The front end 76 has a forward feed corner snubber 80 mounted to a corner of such front end 76 so that it is movable up and down, and more importantly, it is automatically movable downwards with the top of a stack of sheets in the cassette tray 73, for preventing the feeding of multiple sheets at a time. The front end 76 also includes a first sheet guiding wall 84 for supporting the lead edges of a stack of sheets advantageously relative to the corner snubbers 80. In accordance with the present invention, the front wall 84 is made movable up and down with the corner snubber 80. The movable corner snubber 80 is mounted, for example, to a side wall of the cassette frame 74 (FIG. 5) so as to be movable up and down, in a constant downward, relative position to a height of a stack 94 of sheets in the tray 73.

The cassette frame 74 also includes a rear end 88 that has a second sheet guiding wall 90. The second sheet guiding wall 90 is adjustable backwards and forwards, so as to enable handling of a stack 94 of sheets, of various lengths, such as letter size and legal size length sheets. Importantly however, the first and second walls 84, 90 thus cooperate in each cassette tray 73 to place the leading edge of each sheet of the stack 94, at a constant position relative to the forward feed corner snubber 80.

Additionally, in accordance with the present invention, the cassette frame 74 includes a stationary, fixed position base plate 96 for supporting a high capacity stack 94, of more than 250 sheets.

More importantly, the high capaciy, high reliability cassette tray sheet feeding assembly 70 of the present invention further includes a pivotably movable feed wheel assembly 100 that has at least a pair of feed wheels 102 positioned relative to the movable corner snubber 80 for feeding, with a high degree of reliability into the machine, a top sheet SS of a stack of sheets being supported on the fixed position base plate 96.

For cooperating with the pivotable feed wheel assembly 100, the high capaciy, high reliability cassette tray sheet feeding assembly 70 advantageously includes path means 104 defining a variable position sheet path 106 leading from the feed wheels 102 into the machine 8. The path means 104 as shown (FIG. 4) include nip forming, sheet take away upper rollers 108, and lower rollers 110. It also includes upper and lower sheet guides 112, 114 respectively, that are mounted pivotably about the sheet take away lower rollers 110.

Figure 5:
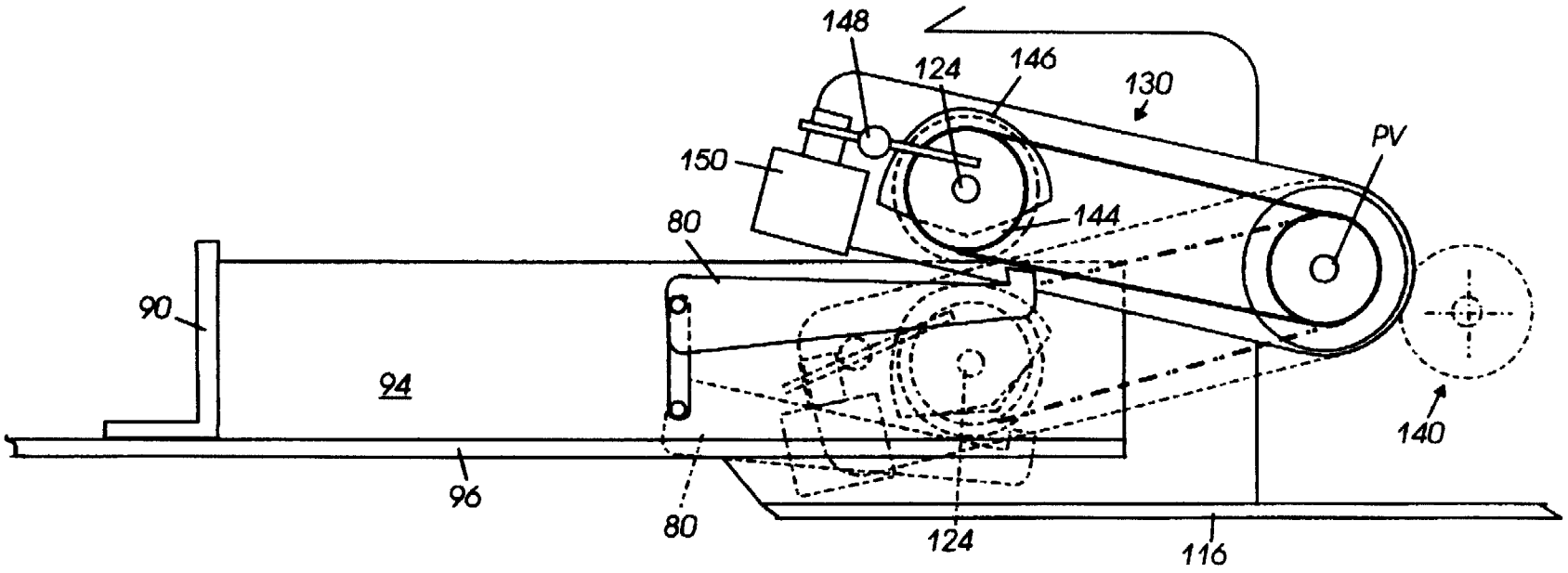
FIG. 5 is a schematic vertical view of the cassette tray sheet feeding assembly of FIG. 1 along the view plane 5—5 showing the fixed position stationary base plate and pivoting feed wheel subassemblies of FIG.
Figure 6:
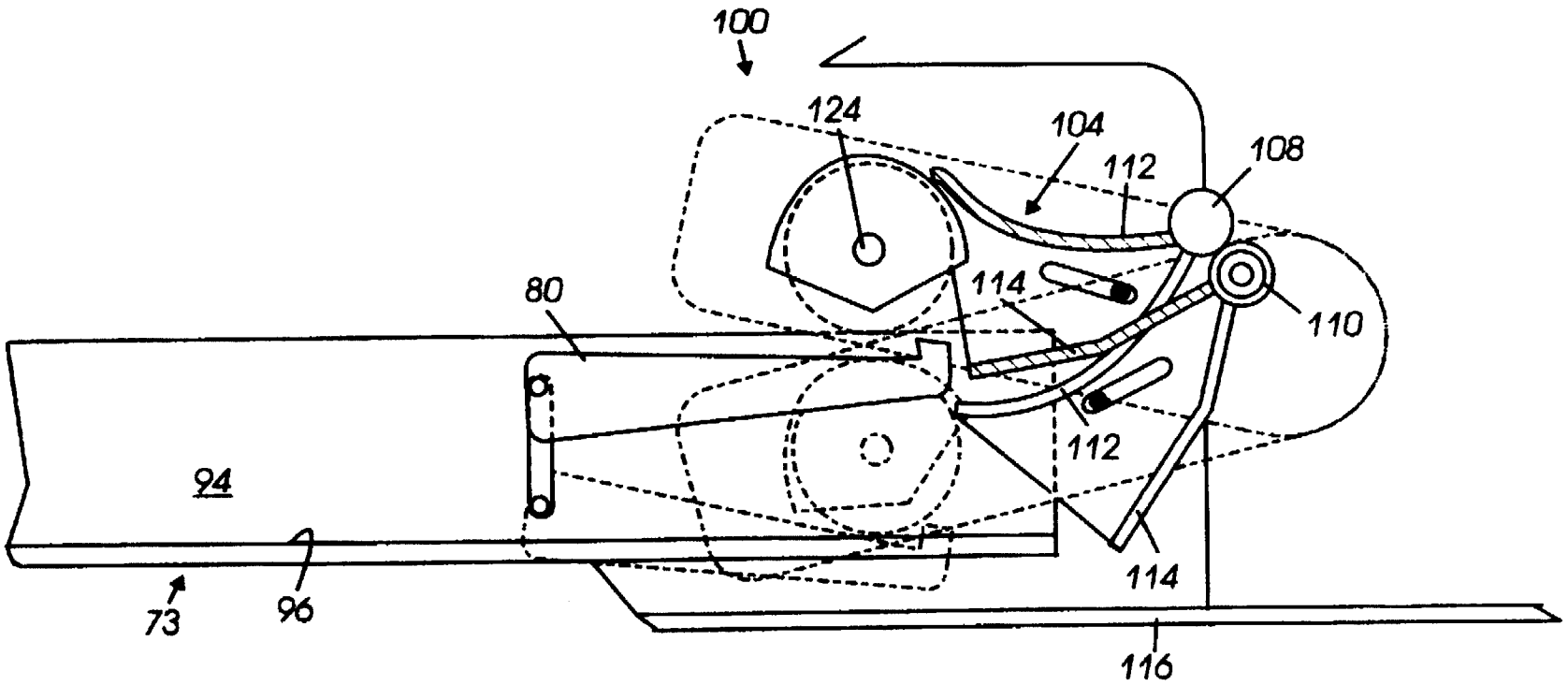
FIG. 6 is a schematic vertical view of the cassette tray sheet feeding assembly of FIG. 1 along the view plane 6—6 showing the fixed position stationary base plate and pivoting feed wheel assembly of FIG. 4.
Figure 7:
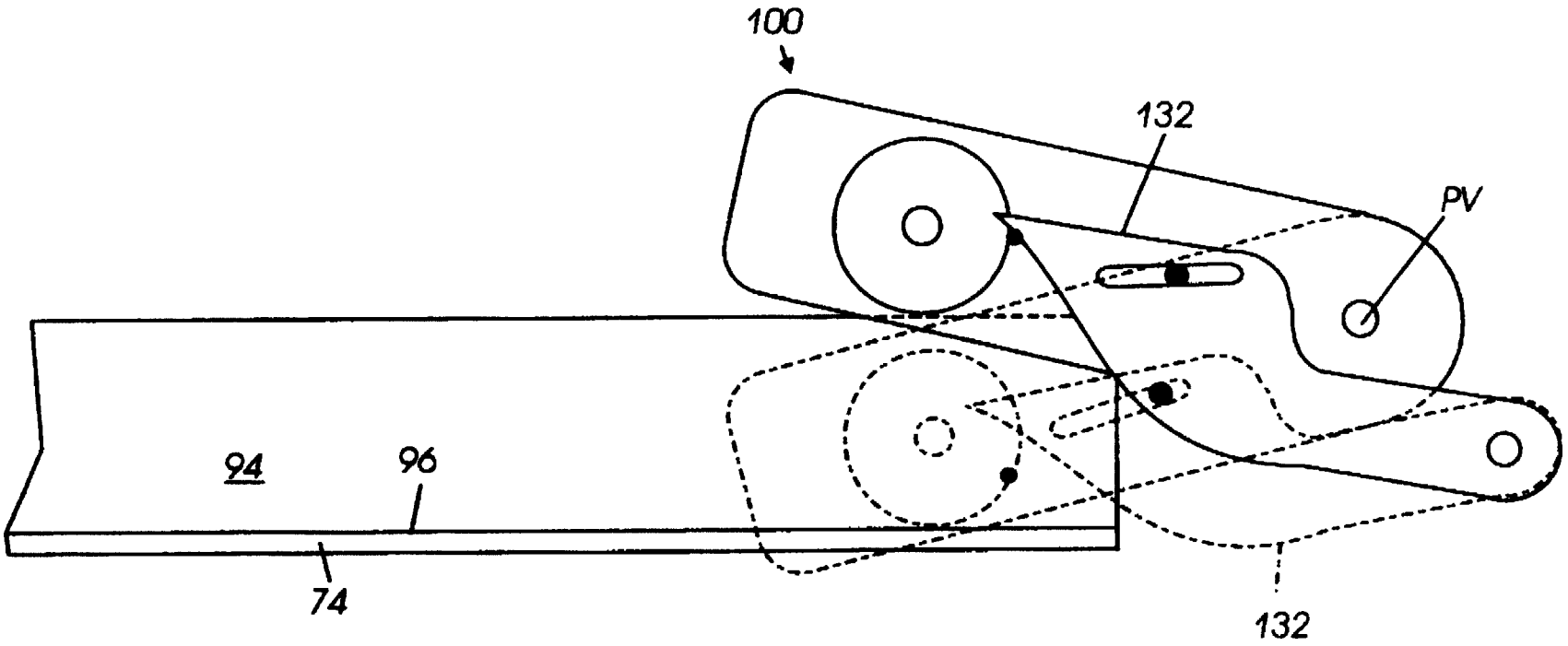
FIG. 7 is a schematic vertical view of the cassette tray sheet feeding assembly of FIG. 4 along the view plane 7—7 showing the fixed position stationary base plate and pivoting feed wheel assembly of FIG. 4.

The pivotably movable feed wheel assembly 100 has a pivot point 116, and a first position PL1 defined by a top of a full stack 94 of sheets (FIGS. 3, 5, and 7). It also has a second position PL2 defined by the fixed position base plate 96. A drive assembly 120 mounted to the frame 116 of the machine for driving and moving the feed wheel assembly between the first and second positions PL1, PL2 respectively. The feed wheels 102 of the feed wheel assembly 100, in being moved from the first position PL1 to the second position PL2, have a constant sheet feeding angle F3° defined by a top sheet to be fed, and a horizontal plane through the movable corner snubber 80, so as to enable continuous high reliability feeding of sheets into the machine. The feed wheels 102, in being moved as such, also have a constant sheet feeding normal force P3 acting on a stack of sheets on the base plate 96, so as to further enable continuous high reliability feeding of sheets into the machine.

In accordance with an aspect of the present invention, a weight supporting means 122 is connected to the shaft 124 of the feed wheels 102 for supporting selectable weights. Accordingly, a selectable weight 126 may advantageously be added to the supporting means 122 for changing a value of the constant normal force P3 acting on the stack of sheets.

The feed wheel assembly 100 as illustrated includes a lifting mechanism 130 that is mounted to the machine frame 116, and that is coupled to the feed wheel shaft 124 for moving the feed wheels 102 pivotably back and forth between the first and the second positions PL1 and PL2 respectively. The lifting mechanism 130 includes pivotable lifting bars 132 which advantageously have a pivot point PV that is spaced a desired distance LD from the front end 76 of the cassette frame 74 so as to maintain the constant sheet feeding angle F3° of the present invention. Additionally, the lifting mechanism 130 includes a drive-assembly 140 that is also mounted to the machine frame 116, as well as, coupled to the lifting bars 132 for moving the lifting bars pivotally about the pivot point PV. The drive assembly 140 includes a drive belt 142 for driving the feed wheel shaft 124, and a wrap spring clutch 144 that enables engagement and disengagement of drive motion to the shaft 124. A control collar 146 mounted over the wrap spring clutch 144 is engageable and disengageable by a pawl 148 that is actuatable by a solenoid switch 150 for enabling and disenabling rotation of the shaft 124.

The feed wheels 102 are each a segmented roll, and are selectively driven through the wrap spring and solenoid controls as above, through a feed stroke or feed cycle so that the uncut length of the circumference of each wheel is in contact with a sheet SS being fed. The feed wheels 102 are mounted pivotably as such so as to have changing path 152 of movement relative to the front end 76 of the cassette frame 74.

To recapitulate, there has been provided in accordance with the present invention, a document production machine using sheets for producing hard copies of images. The document production machine includes a machine frame, image forming means mounted to the machine frame and including marking material for forming a visible image on a sheet, and a cassette receiving aperture defined within a portion of the machine frame for removably receiving a cassette tray assembly suitable for supporting a high capacity (high capacity meaning more than 250 sheets) stack of sheets. The document production machine also includes the pivotably movable feed wheel assembly for feeding with a high degree of reliability from a fixed position base plate cassette tray that is removably insertable into the cassette receiving aperture. The cassette tray having the fixed position base plate, and the pivotably movable feed wheel assembly comprise the high capacity, high reliability cassette tray sheet feeding assembly of the present invention that fully satisfies the aims and advantages hereinbefore set forth While this invention has been described in conjunction with a specific embodiment thereof, it is evident that many alternatives, modifications, and variations will be apparent to those skilled in the art. Accordingly, it is intended to embrace all such alternative, modifications and variations that fall within the spirit and broad scope of the appended claims.

What is claimed is:

1. A document production machine using sheets for producing hard copies of images, the document production machine comprising:

(a) a machine frame;

(b) image forming means mounted to said machine frame and including marking material for forming a visible image on a sheet;

(c) a cassette receiving aperture defined within a portion of said machine frame for removably receiving a cassette tray assembly supporting a high capacity stack of sheets; and (d) a high capacity, high reliability cassette tray sheet feeding assembly mounted in said cassette receiving aperture, said cassette tray sheet feeding assembly including:

(i) a cassette frame having a front end for feeding sheets over into the machine, and a stationary, fixed position base plate for supporting a high capacity stack of sheets;

(ii) a movable forward feed corner snubber mounted to one corner of said front end for preventing the feeding of multiple sheets at a time, said movable corner snubber being mounted to move with a height of a stack of sheets; and (iii) a pivotably movable feed wheel assembly including feed wheels positioned relative to said movable corner snubber for feeding, with a high degree of reliability into the machine, a top sheet of a stack of sheets being supported on said fixed position base plate, said pivotably movable feed wheel assembly having a first position defined by a top of a full stack of sheets on said fixed position base plate, and a second position defined by said fixed position base plate, and a lifting mechanism connected to said machine frame for moving said feed wheels pivotably back and forth between said first and said second positions thereof, said lifting mechanism including a drive assembly mounted to said machine frame and coupled to lifting bars for moving the lifting bars about said pivot point, and said drive assembly including a wrap spring clutch for selectively controlling drive motion of said drive assembly to a shaft of said feed wheels.

2. The document production machine of claim 1, including path means defining a variable position sheet path from said feed wheels into the machine.

3. The document production machine of claim 2, wherein said path means include nip forming sheet take away upper rollers and lower rollers, and upper and lower sheet guides mounted pivotably about said sheet take away lower rollers.

4. The document production machine of claim 1, wherein said marking material of said image forming means comprises charged toner particles.

5. The document production machine of claim 1, wherein said pivotably movable feed wheel assembly has a first position defined by a top of a full stack of sheets on said fixed position base plate, and a second position defined by said fixed position base plate.

6. The document production machine of claim 5, wherein said feed wheels of said feed wheel assembly, in being moved from said first position to said second position of said feed wheel assembly, have a constant sheet feeding angle defined by a top sheet to be fed and a horizontal plane through said movable corner snubber, so as to enable continuous high reliability feeding of sheets into the machine.

7. The document production machine of claim 5, wherein said feed wheels of said feed wheel assembly, in being moved from said first position to said second position of said feed wheel assembly, have a constant sheet feeding normal force acting on a stack of sheets on said fixed position base plate, so as to enable continuous high reliability feeding of sheets into the machine.

8. The document production machine of claim 5, wherein said feed wheel assembly includes a lifting mechanism connected to said machine frame for moving said feed wheels pivotably back and forth between said first and said second positions thereof.

9. The document production machine of claim 8, including a selectable weight for changing a value of said constant normal force acting on the stack of sheets, and supporting means connected to said feed wheels for supporting said selectable weight.

10. The document production machine of claim 9, wherein said lifting mechanism includes pivotable lifting bars having a pivot point spaced a desired distance from said front end of said cassette frame so as to maintain said constant sheet feeding angle of said feed wheels.

11. The document production machine of claim 9, wherein said lifting mechanism includes a drive assembly mounted to said machine frame and coupled to said lifting bars for moving said lifting bars about said pivot point.

12. A high capacity, high reliability cassette tray sheet feeding assembly for supporting a high capacity stack of sheets, and for feeding such sheets with a high degree of reliability, one at a time, in a sheet using machine, the cassette tray sheet feeding assembly comprising:

(a) a cassette frame for removing and reinstalling into a sheet supply station of the sheet using machine, said cassette frame including a front end over which sheets are fed into the machine, and a fixed position stationary base plate for supporting a high capacity stack of sheets having a topmost sheet;

(b) a forward feed corner snubber mounted to one corner of said front end of said cassette frame for preventing the feeding of multiple sheets at a time; and (c) a pivotable feed wheel assembly for reliably feeding topmost sheets seriatim from said fixed position stationary base plate; said pivotable feed wheel assembly having a first position defined by a top of a full stack of sheets on said fixed position base plate, and a second position defined by said base plate empty, said pivotable feed wheel assembly having a constant sheet feeding angle, and a constant sheet feeding normal force, for enabling continuous high reliability feeding of sheets from said first through to said second position thereof, said pivotable feed wheel assembly having a lifting mechanism connected to said machine frame for moving said feed wheels pivotably back and forth between said first and said second positions thereof, said lifting mechanism including a drive assembly mounted to said machine frame and coupled to lifting bars for moving the lifting bars about said pivot point, and said drive assembly including a wrap spring clutch for selectively controlling drive motion of said drive assembly to a shaft of said feed wheels.

* * * * *